US009554216B2

(12) United States Patent
Poulsen

(10) Patent No.: US 9,554,216 B2
(45) Date of Patent: Jan. 24, 2017

(54) BONE-SEALED AUDIO DEVICE HAVING INSERTION PART WITH ADHESIVE AND PHASE-CHANGING MATERIAL

(71) Applicant: Oticon A/S, Smørum (DK)

(72) Inventor: Henning Knak Poulsen, Roskilde (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 14/331,721

(22) Filed: Jul. 15, 2014

(65) Prior Publication Data

US 2015/0038774 A1 Feb. 5, 2015

(30) Foreign Application Priority Data

Aug. 1, 2013 (EP) ..... 13178869

(51) Int. Cl.
*H04R 25/00* (2006.01)
*H04R 1/10* (2006.01)

(52) U.S. Cl.
CPC ..... *H04R 25/00* (2013.01); *H04R 25/608* (2013.01); *H04R 25/652* (2013.01); *H04R 1/1016* (2013.01); *H04R 2225/023* (2013.01); *H04R 2225/025* (2013.01)

(58) Field of Classification Search
CPC ..... H04R 25/656; H04R 25/606; H04R 25/04
USPC ..... 381/328–330
See application file for complete search history.

(56) References Cited

U.S. PATENT DOCUMENTS

| | | | | |
|---|---|---|---|---|
| 4,905,322 | A | 3/1990 | Aileo et al. | |
| 5,721,198 | A * | 2/1998 | Burba, III | B82Y 30/00 507/140 |
| 6,094,494 | A | 7/2000 | Haroldson | |
| 6,135,235 | A * | 10/2000 | Brimhall | H04R 25/654 181/129 |
| 6,485,803 | B1 * | 11/2002 | Bright | B29C 63/06 156/86 |
| 7,141,014 | B2 | 11/2006 | Saltykov | |
| 2003/0078555 | A1 * | 4/2003 | Kerins | A61L 15/58 604/385.03 |
| 2004/0165742 | A1 * | 8/2004 | Shennib | H04R 25/456 381/326 |
| 2005/0169491 | A1 | 8/2005 | Pitt et al. | |
| 2007/0118222 | A1 * | 5/2007 | Lang | A61F 2/441 623/17.12 |

(Continued)

FOREIGN PATENT DOCUMENTS

| | | | |
|---|---|---|---|
| JP | 8-275298 | A | 10/1996 |
| NL | 1032220 | C2 | 1/2008 |

(Continued)

*Primary Examiner* — Curtis Kuntz
*Assistant Examiner* — Julie X Dang
(74) *Attorney, Agent, or Firm* — Birch, Stewart, Kolasch & Birch, LLP

(57) ABSTRACT

An audio device with an insertion part being adapted to be inserted into an ear canal of a user. The insertion part comprises pressure means and a resilient surface. The resilient surface comprises an adhesive, which is adapted to adhere to a skin portion of a bony portion of an ear canal of a user. The pressure means are adapted to provide a force to press the adhesive against the skin portion. The pressure means include a phase-changing material, which is adapted to cause a reduction in the force, when heat is supplied to the phase-changing material.

19 Claims, 3 Drawing Sheets

(56) References Cited

U.S. PATENT DOCUMENTS

Figure 1:
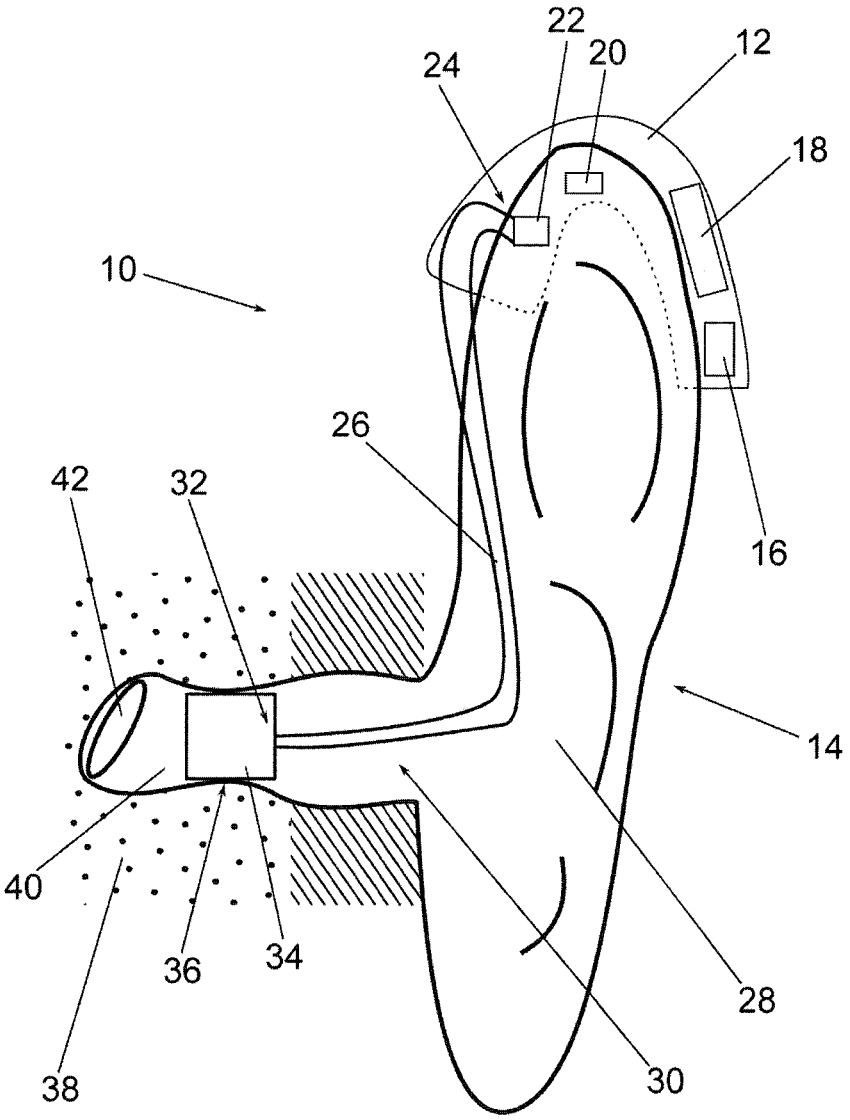

| | | | | |
|---|---|---|---|---|
| 2011/0027331 | A1* | 2/2011 | Hobot | A61K 9/0004 424/422 |
| 2012/0010735 | A1 | 1/2012 | Gilboa | |
| 2012/0068379 | A1 | 3/2012 | Klemenz et al. | |
| 2012/0300965 | A1* | 11/2012 | Samuels | H04R 25/00 381/328 |

FOREIGN PATENT DOCUMENTS

| | | | |
|---|---|---|---|
| WO | WO 2007/146934 | A2 | 12/2007 |
| WO | WO 2010/136457 | A1 | 12/2010 |

* cited by examiner

BONE-SEALED AUDIO DEVICE HAVING INSERTION PART WITH ADHESIVE AND PHASE-CHANGING MATERIAL

FIELD

The disclosure relates to an audio device with an insertion part, which is adapted to be inserted into an ear canal of a user and to adhere to a skin portion of a bony portion of the ear canal.

BACKGROUND

Audio devices include for example hearing aids, loudspeaker units for a hearing aid or a headset or the like. Hearing aids can be characterized by the way they are fitted to the ear of a user. Conventional hearing aids include for example ITE (In-The-Ear), ITC (In-The-Canal), CIC (Completely-In-the-Canal) and BTE (Behind-The-Ear) hearing aids. The components of the ITE hearing aids are mainly located in an ear, while ITC and CIC hearing aid components are located in an ear canal. BTE hearing aids are generally mounted behind or on an ear of a user. The hearing aids all have at least a microphone, a power source, electric circuitry and a receiver (speaker). The receiver generates sound, which can be guided to a tympanic membrane in the ear canal of a user for auditory perception. Therefore all hearing aids have at least one insertion part, which is adapted to be inserted into an ear canal of a user to guide the sound to a tympanic membrane. The insertion part can for example be a loudspeaker unit for a hearing aid or a headset.

Inserting an insertion part of an audio device into an ear canal that transmits device generated sound into the ear canal can lead to various acoustic effects, e.g., a comb filter effect, sound oscillations or occlusion. Simultaneous occurrence of device generated and natural sound in an ear canal of a user creates the comb filter effect, as the sounds reach the tympanic membrane with a time delay. Sound oscillations generally occur only for audio devices including a microphone, with the sound oscillations being generated through sound reflections off the ear canal to the microphone of the audio device. A common way to suppress the aforementioned acoustic effects is to close the ear canal, which effectively prevents natural sound to reach the tympanic membrane and device generated sound to leave the ear canal. Closing the ear canal, however, leads to the occlusion effect, which corresponds to an amplification of a person's own voice when the ear canal is closed, as bone-conducted sound vibrations cannot escape through the ear canal and reverberate off the insertion part of the audio device. To reduce the occlusion the insertion part of the audio device can be inserted deeper into the ear canal to adhere to a bony portion of the ear canal and to seal the ear canal.

To seal the bony portion of an ear canal with the insertion part of the audio device often a moisture-activated adhesive is applied on the outside surface of the insertion part, e. g., a loudspeaker unit. The adhesive has to be pressed against the skin of the ear canal to ensure a reliable adhesion to the skin. The skin in the bony portion of an ear canal is sensitive to pressure and the required pressure applied to the skin often causes pain, skin irritations and wounds in the ear canal.

U.S. Pat. No. 7,141,014 B2 shows a cushioning device for use with a hearing aid instrument for positioning of the hearing aid instrument in the ear of a user. The cushioning device comprises a ring volume with a pliant substance disposed within the ring volume and a reservoir, which are in fluid communication. The ring volume encircles a predetermined portion of a hearing aid housing configured to generally conform to the shape of the ear canal and separates it from a portion of a user's ear canal. The hearing aid housing contains the electronic of the hearing aid instrument. A pressure of the pliant substance can be increased or decreased by closing or opening a door movably disposed at an end of the hearing aid instrument opposite the ring volume.

U.S. Pat. No. 6,094,494 presents a device and method for fitting a sound transmission device with an ear-piece component comprising a housing having a face at one end with operative components and a stem adjacent the other end. The stem houses a speaker tube and retaining means for securing an inflatable, resilient fitting balloon. The component and attached fitting balloon are inserted into the ear canal when the balloon is in a deflated configuration. The fitting balloon is inflated through air supply through an air channel of the stem housing when the balloon is in the ear canal, which engages the ear-piece component against the walls and prevents sound from entering and escaping the ear.

In WO 2010/136457 A1 an ear fitting piece for creating an ear impression and a method for creating an ear impression is presented. The ear fitting piece comprises a soft rubber sleeve enclosing a liquid with a first state in which it can be shaped and a second state in which it is solidified and an activating means, which is designed to cause a change of state from the first to the second state of the liquid. A change from the second state to the first state of the liquid can be caused by heating.

WO 2007/146934 A2 presents a seal for retaining a hearing device within a portion of the ear canal. The seal comprises a curved compliant shell with a wall and an opening at an apex portion of the shell. The shell wall defines a cavity for retention of a hearing device component. A portion of the shell comprises a resilient material with sound attenuating properties. The structure of the shell allows a force for removal of the seal from the ear canal to be greater than a force for the insertion of the seal into the canal. The seal can be configured to be seated in a bony portion of the ear canal. A coating that enhances adhesion between the seal and the canal can be applied on the seal to facilitate retention in the ear canal. The seal can be of biocompatible materials and can further be configured to exert a force on the epithelium less than the venous return pressure of the epithelial vasculature.

The disclosure provides an an improved audio device for insertion into the bony portion of the ear canal.

SUMMARY

An audio device with at least one insertion part that is adapted to be inserted into an ear canal of a user is disclosed. The insertion part comprises pressure means and a resilient surface. The pressure means comprise a phase-changing material and the resilient surface comprises an adhesive. The adhesive is adapted to adhere to a skin portion of a bony portion of an ear canal of a user. The pressure means are adapted to provide a force to press the adhesive against the skin portion. The phase-changing material is adapted to cause a reduction in the force, when heat is supplied to the phase-changing material.

In one aspect, the pressure to ensure reliable adhesion of the insertion part of the audio device to the skin is reduced, as pressure is applied by means of a phase-changing material. The time period of exposure of pressure is reduced as the phase-changing material changes its phase through a higher temperature at the location of use, which reduces the pressure. Another aspect is the mechanical simplicity of the solution, as the insertion of the audio device does not require insertion means. The audio device can be easily handled during insertion and withdrawal.

In one embodiment, the adhesive on the resilient surface is adapted to be activated after inserting the insertion part of the audio device in the bony portion of an ear canal of a user. The adhesive is preferably activated after the insertion part is in position in the bony portion, as skin can be damaged or insertion can be hindered if the adhesive is activated before it reaches the bony portion. The activation can for example be caused by relative humidity, temperature, by an activation means, e. g., through an electrical signal into the adhesive material or similar means. The adhesive can be adapted to be activated by a relative humidity in a range between 10% and 100%, preferably between 20% and 80%, and most preferably between 40% and 70%. Alternatively or as a combination with the relative humidity requirement for activation the adhesive can be adapted to be activated when the average temperature around the adhesive raises above an activation temperature of about 33° C., preferably about 35° C., most preferably about 36° C. The relative humidity and temperature for activation are preferably configured to be in a preferable range of a normal human ear canal or individually configured to a user's ear canal.

The adhesive can also comprise two or more components, which are intended to be mixed with each other immediately before use and which are adapted to be activated with a time delay after the mixing.

Preferably, the phase-changing material, e. g., paraffin wax, sebacic acid or the like, is adapted to cause the reduction in the force to press the adhesive against the skin portion of an ear canal of a user only after the adhesive has been activated. Phase-changing material and adhesive can be materials with properties adjusted to each other in order to have an activation of the adhesive before the phase-changing material reduces its force, e. g., by a phase change. The phase-changing material can for example be a material that has a higher melting temperature than the activation temperature of the adhesive or that needs a higher relative humidity to induce a phase change than the relative humidity needed to activate the adhesive.

In a preferred embodiment, the phase-changing material has at least one elastic phase. Preferably the phase-changing material has also a fluid phase and/or a semi-fluid phase. The phase-changing material can also have several elastic phases or solid phases. The phase-changing material in elastic phase can allow the insertion part of the audio device to be rigid enough to be inserted into an ear canal without insertion means and flexible enough to conform at least partly to the form of the ear canal. The insertion part with the phase-changing material in the elastic phase can occupy a predetermined volume in an ear canal of a user by which enough pressure is generated to press the adhesive against a skin portion in the bony portion of an ear canal of a user to ensure proper adhesion between the adhesive and the skin portion. The phase-changing material in fluid or semi-fluid phase can flow through an ear canal to leave it. Preferably at least one phase transition between an elastic or solid and fluid or semi-fluid phase occurs for a transition temperature or transition temperature range in the temperature range of between 0° C. to 100° C., preferably between 20° C. and 60° C., most preferably between 30° C. and 40° C. In one embodiment the phase-changing material is inserted into an ear canal in an elastic phase and performs a phase-transition into the fluid or semi-fluid phase to release pressure on the skin portion of the ear canal and optionally leave the ear canal by flowing out of the ear canal.

In another embodiment, the phase-changing material is enclosed in a flexible housing, for example a flexible casing, a hollow space of the insertion part or the like. In an elastic phase the phase changing material preferably occupies only a fraction of the volume of the flexible housing. In the fluid or the semi-fluid phase the phase-changing material can have a low enough viscosity to adapt to a shape of an arbitrary housing volume, so that it can fill the complete flexible housing. A phase transition from elastic to fluid may increase the volume of the phase-changing material. A reduction of the pressure on the skin portion of an ear canal can be possible by elastic to fluid phase transition, when the accessible volume for the phase-changing material in the fluid phase is increased compared to the elastic phase, e.g. by the flexible casing expanding in a direction other than towards the skin portion.

In one embodiment, the phase changing-material is adapted to change its phase when the temperature is changed in a range between 0° C. and 40° C., preferably between 25° C. and 38° C., most preferably between 30° C. and 36° C. The change can for example be from an elastic phase to a fluid or semi-fluid phase.

Preferably, all phase changes are reversible. In another embodiment the phase change can be non reversible. In one embodiment the phase-changing material is adapted to reversibly change from an elastic phase to a fluid or semi-fluid phase when the average temperature around the phase-changing material raises above an activation temperature of about 33° C., preferably about 35° C., most preferably about 36° C.

In a preferred embodiment, the audio device comprises a receiver, which is adapted to convert an electric signal to an acoustic signal. The electric signal can for example be generated by a microphone that records sound from an acoustic environment. The audio device can be a hearing aid that includes a microphone, a power source, electric circuitry and the receiver. The electric circuitry can for example also include an amplifier. In an-other embodiment the audio device is a loudspeaker unit for a hearing aid or a head set or the like. The audio device can also comprise a Behind-The-Ear unit, with the insertion part comprising a loudspeaker unit or a receptacle for an acoustic tube to transmit sound from the Behind-The-Ear unit to an ear canal of a user. The audio device can also be comprised in the insertion part.

The insertion part of the audio device can be adhesively affixed in a tubular cavity, e. g., an ear canal of a user. A method to affix the insertion part preferably comprises the steps of inserting the insertion part of the audio device into the tubular cavity, providing a force, which presses the adhesive applied to the resilient surface of the audio device against a wall of the cavity, and providing heat in the cavity, which causes a phase change from an elastic to a fluid or semi-fluid phase in the phase-changing material. The heat is preferably provided by the user's body. If required, further heat may be provided by other means through the outer ear. The phase transition of the phase-changing material preferably leads to a reduction in the force pressing the adhesive against the wall of the cavity.

BRIEF DESCRIPTION OF ACCOMPANYING FIGURES

Figure 2:
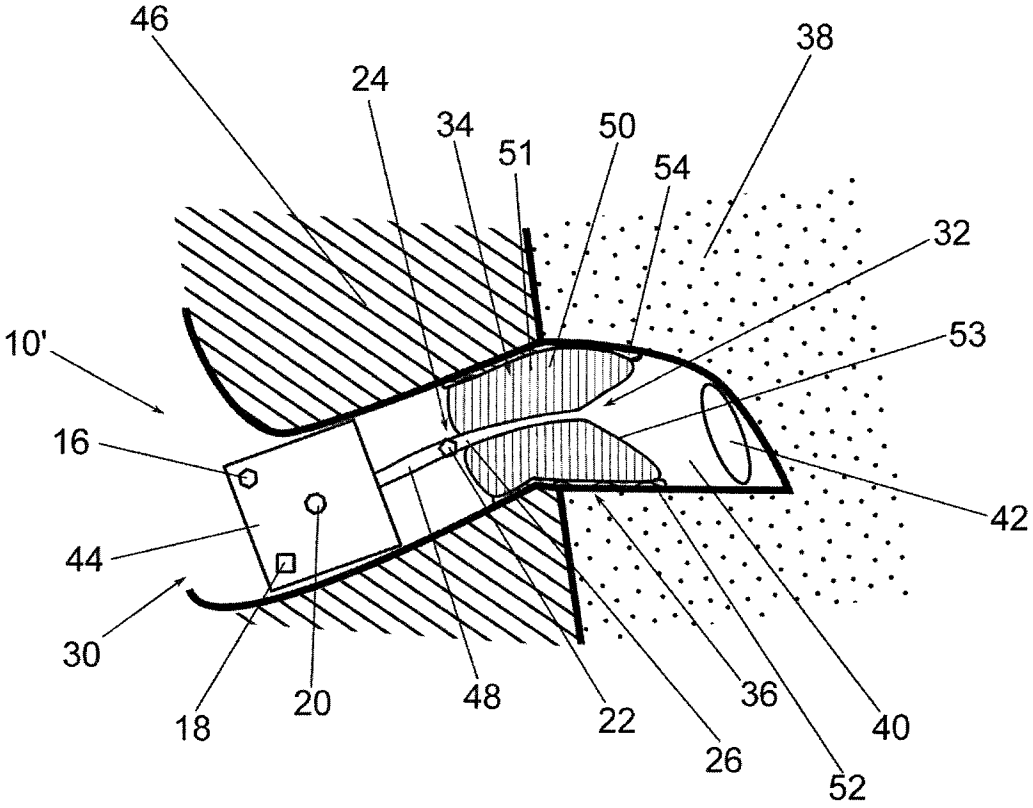
Figure 3:
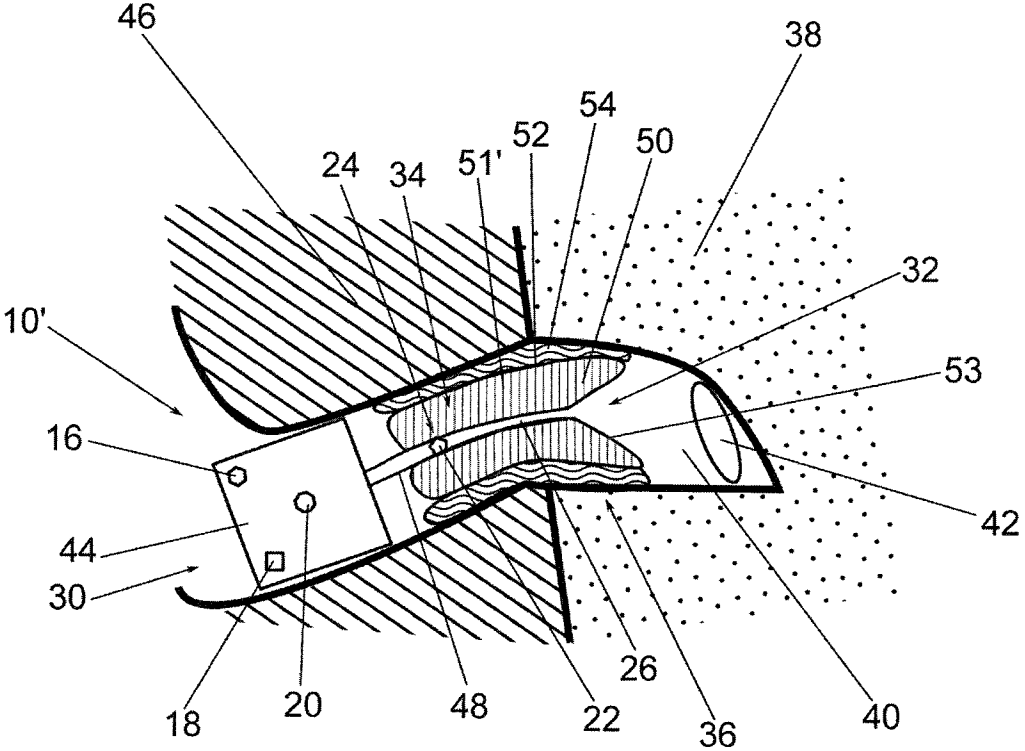

The disclosure will be more fully understood from the following detailed description of embodiments thereof, taken together with the drawings in which:

FIG. 1 shows a schematic illustration of a human ear with a first embodiment of an audio device with a BTE (Behind-The-Ear) unit connected to a thin tube that is connected to an insertion part that adjoins to an ear canal of the human ear according to an aspect of the disclosure;

FIG. 2 shows a schematic illustration of an ear canal with a second embodiment of an audio device with an insertion part including a phase-changing material in elastic phase that adjoins to the ear canal according to an aspect of the disclosure; and FIG. 3 shows a schematic illustration of an ear canal with a second embodiment of an audio device with an insertion part including a phase-changing material in fluid or semi-fluid phase with an adhesive, which adjoins to the ear canal according to an aspect of the disclosure.

DETAILED DESCRIPTION

FIG. 1 shows a first embodiment of an audio device 10 with a Behind-The-Ear (BTE) unit 12 mounted behind an ear 14 of a user according to an aspect of the disclosure. The BTE unit 12 has a microphone 16, a power source 18, electric circuitry 20 and a receiver 22. The microphone 16 records sound from the acoustic environment and generates electric signals from the recorded sound. The electric circuitry 20 processes and/or amplifies the electric signals, e. g., through a processing unit or an amplifier (not shown). The processed signals are transmitted to the receiver 22, where sound is generated from the electric signals. The receiver 22 is acoustically connected to a proximal end 24 of an acoustic tube 26. The acoustic tube 26 is configured to follow the form of the ear 14 through the concha 28 and into the ear canal 30. The distal end 32 of the acoustic tube 26 is fluidly, and thus acoustically connected to a receptacle in an insertion part 34 and can thus transmit the sound into the ear canal 30. The insertion part 34 can also contain a receiver 22, in this case the insertion part 34 may comprise a loudspeaker unit connected by a lead instead of an acoustic tube 26. The insertion part 34 adheres to a skin portion 36 of a bony portion 38 of the ear canal 30 to close and seal the ear canal 30, which prevents the escape and intrusion of sound. An ear canal cavity 40 separates the insertion part 34 from the tympanic membrane 42, where the sound generated by the BTE unit 12 is received and ultimately processed for the auditory perception of the user of the audio device 10.

FIG. 2 shows a schematic illustration of an ear canal 30 with a second embodiment of an audio device 10' connected to an insertion part 34 according to an aspect of the disclosure. The audio device 10' is a CIC (Completely-In-the-Canal) hearing aid with a CIC (Completely-In-the-Canal) unit 44 in a cartilaginous portion 46 of the ear canal 30. The CIC unit 44 has a microphone 16, a power source 18 and electric circuitry 20 and is connected to a receiver 22 with a lead 48. Sound recorded from the microphone 16 is processed in the CIC unit 44 by the electric circuitry 20 and transmitted to the receiver 22 as an electric signal. The receiver 22 is located at a distal end 24 of an acoustic tube 26, which is part of an insertion part 34 and which lead sound from the receiver 22 to the tympanic membrane 42. The insertion part 34 contains a pressure means 50 with a phase-changing material 51, e. g., paraffin wax, sebacic acid or the like, enclosed in a flexible housing 53. The insertion part 34 has a resilient surface 52 with an adhesive 54. The pressure means 50 containing the phase-changing material 51 in an elastic phase press the adhesive 54 against a skin portion 36 of the bony portion 38, which closes the ear canal 30. The adhesive 54 is adapted to be activated after inserting the insertion part 34 of the audio device 10' in the bony portion 38 of the ear canal 30. Sound generated from the electric signals by the receiver 22 is transmitted through the acoustic tube 26 which ends in an ear canal cavity 40, which contains a tympanic membrane 42. The tympanic membrane 42 can process the sound for auditory perception of the user of the audio device 10'.

The activation of the adhesive 54 can for example be caused by an increase of relative humidity, temperature, by an activation means, e. g., through an electric signal or similar means. The adhesive 54 can be adapted to be activated by a relative humidity in a range between 10% and 100%, preferably between 20% and 80%, and most preferably between 40% and 70%. The adhesive 54 can alternatively or as a combination with the relative humidity activation requirement be adapted to be activated when an average temperature around the adhesive 54 raises above an activation temperature that is about 33° C., preferably about 35° C., most preferably about 36° C. The relative humidity and temperature for activation are preferably configured to be in a preferable range of a normal human ear canal 30 or individually configured to a user's ear canal 30.

The adhesive 54 can also comprise two or more components (not shown), which are adapted to be activated with a time delay after mixing. The activation time may be further delayed by further known mechanisms, such as a required activation temperature and/or activation humidity.

The insertion part 34 of the audio device can be adhesively affixed in an ear canal 30 of a user. A method to affix the insertion part 34 preferably comprises the steps of inserting the insertion part 34 of the audio device 10' into the ear canal 30, providing a force, e. g., using the pressure means 50 which press the adhesive 54 applied to the resilient surface 52 of the audio device 10' against a skin portion 36 of the bony portion 38 of the ear canal 30.

Heat is provided in the ear canal 30 by the user's body, which causes a phase change from an elastic to a fluid or semi-fluid phase in the phase-changing material 51'. The phase transition of the phase-changing material 51' preferably leads to a reduction in the force pressing the adhesive 54 against the wall of the ear canal 30.

FIG. 3 shows the audio device 10' of FIG. 2 with the only difference that a phase-changing material 51' of the pressure means 50 is in a fluid phase. The adhesive 54 connects the resilient surface 52 of the insertion part 34 with the skin portion 36. The skin portion 36, which the adhesive 54 adheres to, can be arranged only in the bony portion 38 or alternatively, as shown in this embodiment, the skin portion 36 can also extend into the cartilaginous region 46 of the ear canal 30. The phase-changing material 51' in a fluid phase causes a reduction in force on the skin portion 36, as the flexible housing 53 enclosing the phase-changing material 51' deforms and becomes elongated along the ear canal 30. The phase-changing material 51' can be adapted to cause the reduction in the force on the skin portion 36 only after the activation of the adhesive 54.

The phase-changing material 51' can have one or more elastic, fluid, semi-fluid and/or solid phases. Preferably, the phase-changing material 51' has at least one elastic and one fluid phase, which are connected by a phase transition. The phase transition can for example occur for a transition temperature or transition temperature range in the temperature range of between 0° C. to 40° C., preferably between 20° C. and 38° C., most preferably between 30° C. and 36° C. The phase-changing material 51' can change its phase from an elastic phase to a fluid or semi-fluid phase when the average temperature around the phase-changing material 51' raises above an activation temperature of about 33° C., preferably about 35° C., most preferably about 36° C. The phase transition can be reversible or irreversible.

Throughout the foregoing description, for the purposes of explanation, numerous specific details were set forth in order to provide a thorough understanding of the disclosure. The description is provided to enable any person skilled in the art to practice the various aspects described herein. It will be apparent, however, to one skilled in the art that the disclosure may be practiced without some of these specific details and various modifications, in compliance with the disclosed generic principle, to these aspects may be applied. All structural and functional equivalents to the elements of the various aspects described throughout this disclosure that are known to those of ordinary skill in the art are expressly incorporated herein by reference and are intended to be encompassed by the claims.

Accordingly, the scope should be judged in terms of the claims which follow.

REFERENCE SIGNS

10 audio device
12 Behind-The-Ear (BTE) unit
14 ear
16 microphone
18 power source
20 electric circuitry
22 receiver
24 proximal end
26 acoustic tube
28 concha
30 ear canal
32 distal end
34 insertion part
36 skin portion
38 bony portion
40 ear canal cavity
42 tympanic membrane
44 CIC (Completely-In-the-Canal) unit
46 cartilaginous portion
48 lead
50 pressure means
51 phase-changing material
52 resilient surface
53 flexible housing
54 adhesive

The invention claimed is:

1. An audio device, comprising:

at least one insertion part adapted to be inserted into an ear canal of a user; wherein the insertion part comprises a pressure means that comprise a phase-changing material and the insertion part further comprises a resilient surface comprising an adhesive, which is adapted to adhere to a skin portion of a bony portion of an ear canal of a user;

the pressure means are adapted to provide a force to press the adhesive against the skin portion and the phase-changing material is adapted to cause a reduction in the force, when heat is supplied to the phase-changing material; and wherein the adhesive comprises at least two components, wherein the components of the adhesive are adapted to be activated with a time delay after mixing the at least two components.

2. The audio device according to claim 1, wherein the adhesive is adapted to be activated after insertion of at least the insertion part of the audio device in the bony portion of a user's ear canal.

3. The audio device according to claim 1, wherein the adhesive is adapted to be activated by a relative humidity in a range between 10% and 100%.

4. The audio device according to claim 1, wherein the adhesive is adapted to be activated by an average temperature around the adhesive raising above an activation temperature of about 33° C.

5. The audio device according to claim 1, wherein the phase-changing material is adapted to cause the reduction in the force only after activation of the adhesive.

6. The audio device according to claim 1, wherein the phase-changing material has at least one elastic phase.

7. The audio device according to claim 1, wherein the phase-changing material has at least one fluid or semi-fluid phase.

8. The audio device according to claim 1, wherein the phase changing-material is adapted to change its phase for a transition temperature or transition temperature range in the temperature range of between 20° C. to 40° C.

9. The audio device according to claim 6, wherein the phase-changing material is adapted to reversibly change from the elastic phase to a fluid or semi-fluid phase when the average temperature around the phase-changing material raises above an activation temperature of about 33° C.

10. The audio device according to claim 1, wherein the insertion part comprises at least one hollow space which comprises the phase changing material.

11. The audio device according to 1, wherein the phase-changing material is enclosed in a flexible casing.

12. The audio device according to claim 1, wherein the audio device comprises a receiver, which is adapted to convert an electric signal to an acoustic signal.

13. The audio device according to claim 1, wherein the audio device is a hearing aid further comprising a microphone, a power source, electric circuitry and a receiver.

14. A method for adhesively affixing an insertion part of an audio device in a tubular cavity, the method comprising:

inserting the insertion part of the audio device into the tubular cavity, the insertion part having a resilient surface including an adhesive;

providing a force pressing the adhesive applied to the resilient surface of the audio device against a wall of the cavity;

providing heat in the cavity, which causes a phase change from elastic to fluid or semi-fluid in the phase-changing material leading to a reduction in the force pressing the adhesive against the wall of the cavity; and wherein the adhesive comprises at least two components, wherein the components of the adhesive are adapted to be activated with a time delay after mixing the at least two components.

15. The audio device according to claim 3, wherein the adhesive is configured to be activated by a relative humidity in the range between 40% and 70%.

16. The audio device according to claim 4, wherein the adhesive is adapted to be activated by an average temperature around the adhesive raising above an activation temperature of approximately 36° C.

17. The audio device according to claim 8, wherein phase changing-material is adapted to change its phase for a transition temperature or transition temperature range in the temperature range of between 30° C. to 36° C.

18. The audio device according to claim 9, wherein the phase-changing material is adapted to reversibly change from the elastic phase to a fluid or semi-fluid phase when the average temperature around the phase-changing material raises above an activation temperature of about 36° C.

19. The audio device according to claim 1, wherein the phase-changing material has a melting temperature, the adhesive has adhesive adheres to the skin portion when an average temperature around the adhesive raises above an activation temperature, and the melting temperature of the phase-changing material is higher than the activation temperature.

* * * * *